73-151.5
7/11/78 OR 4,099,410
SR

United States Patent [19]

Martin

[11] 4,099,410

[45] Jul. 11, 1978

[54] RATE OF PENETRATION RECORDER

[75] Inventor: T. Edward Martin, Oklahoma City, Okla.

[73] Assignee: Arthur J. Connelly, Farmington, N. Mex. ; a part interest

[21] Appl. No.: 836,409

[22] Filed: Sep. 26, 1977

[51] Int. Cl.[2] ..... E21B 45/00
[52] U.S. Cl. ..... 73/151.5
[58] Field of Search ..... 73/151.5, 152

[56] References Cited

U.S. PATENT DOCUMENTS

| | | | |
|---|---|---|---|
| 3,541,852 | 11/1970 | Brown et al. | 73/151.5 |
| 3,777,560 | 12/1973 | Guignard | 73/151.5 |
| 3,853,004 | 12/1974 | Westlake et al. | 73/151.5 |
| 3,916,684 | 11/1975 | Rundell | 73/151.5 |

*Primary Examiner*—Anthony V. Ciarlante
*Attorney, Agent, or Firm*—Dunlap, Codding & McCarthy

[57] ABSTRACT

A latching control circuit for a rate of penetration recorder providing an output indication in response to the vertically downward movement of a drilling swivel a predetermined penetration distance.

10 Claims, 5 Drawing Figures

RATE OF PENETRATION RECORDER

BACKGROUND OF THE INVENTION

1. Field of the Invention

This invention relates generally to improvements in rate of penetration recorders and, more particularly, but not by way of limitation, to a rate of penetration recorder having a latching control circuit for preventing the production of erroneous output signals.

2. Description of the Prior Art

In drilling wells for the discovery and production of oil, water or the like, it is often of critical importance to know the precise depth of the drill bit, as well as the time at which the depth was attained. In accomplishing this data acquisition, various devices have been designed, and are generally referred to as rate of penetration recorders. A number of such prior art devices are disclosed in the following U.S. Pat. Nos.: 3,541,852, issued to Brown et al.; 3,777,560, issued to Guignard; and 3,853,004, issued to Westlake et al. Related apparatus of more general interest to the subject invention are disclosed in the following U.S. Pat. Nos. 2,322,478, issued to Scherbatskoy; 2,330,752, issued to Sikes, Jr.; 2,330,753, also issued to Sikes, Jr.; 2,539,758, issued to Silverman et al.; 2,688,871, issued to Lubinski; 2,957,346, issued to Knight; 3,374,669, issued to Redwine; 3,522,727, issued to Calhoun; 3,620,077, issued to Brown et al.; 3,785,202, issued to Kelseaux et al.; 3,881,695, issued to Joubert; 3,891,038, issued to Delestrade et al.; 3,898,880, issued to Kelseaux et al.; and 3,391,735, issued to Guignard. Various other types of measuring devices used in well drilling are disclosed in the following U.S. Pat. Nos.: 2,166,212, issued to Hayward; 3,027,649, issued to Sloan; 3,368,400, issued to Jorden, Jr., et al.; 3,490,150, issued to Whitfill, Jr.; 3,643,504, issued to Rundell; 3,651,871, issued to Greene; 3,660,649, issued to Gilchrist; 3,752,966, issued to Foy, Jr., et al.; and 3,912,684, also issued to Rundell.

SUMMARY OF THE INVENTION

In a rate of penetration recorder having a shaft which rotates once in response to the vertically downward movement of a drilling swivel a predetermined penetration distance, a latching control circuit having a sensor portion which provides set and reset signals in response to the rotation of the shaft to predetermined set and reset positions, respectively, and a circuit portion which is positioned in a set state in response to receiving the set signal while positioned in a reset state, and which is positioned in the reset state in response to receiving the reset signal while positioned in the set state, the circuit portion providing a step-penetration signal indicative of the vertically downward movement of the drilling swivel the predetermined penetration distance in response to being positioned in the set state. A further improvement in a rate of penetration recorder having a secondary shaft which rotates once in response to the vertically downward movement of the drilling swivel a predetermined multiple of the penetration distance, comprises a sensor portion which provides a gate signal in response to each rotation of the secondary shaft, wherein the circuit portion provides a multiple-penetration signal indicative of the vertically downward movement of the drilling swivel the predetermined multiple in response to being positioned in the set state while simultaneously receiving the gate signal.

It is an object of the present invention to improve the operation of a rate of penetration recorder so as to preclude production of erroneous output signals.

Another object of the present invention is to provide an improved rate of penetration recorder which is highly immune to relatively small vertical oscillations of the drilling swivel resulting from normally occurring drilling activity.

A further object of the present invention is to provide an improved control circuit which may be installed for use on a conventional rate of penetration recorder with only a minimum amount of modification.

A still further object of this invention is to provide an improved rate of penetration recorder which is highly reliable and predictable in operation.

Yet another object of this invention is to provide an improved rate of penetration recorder which is very economical in construction and simple in operation and maintenance.

Other objects and advantages of the invention will be evident from the following detailed description when read in conjunction with the accompanying drawings which illustrate the preferred embodiment of the invention.

DESCRIPTION OF THE PREFERRED EMBODIMENT

Figure 1:
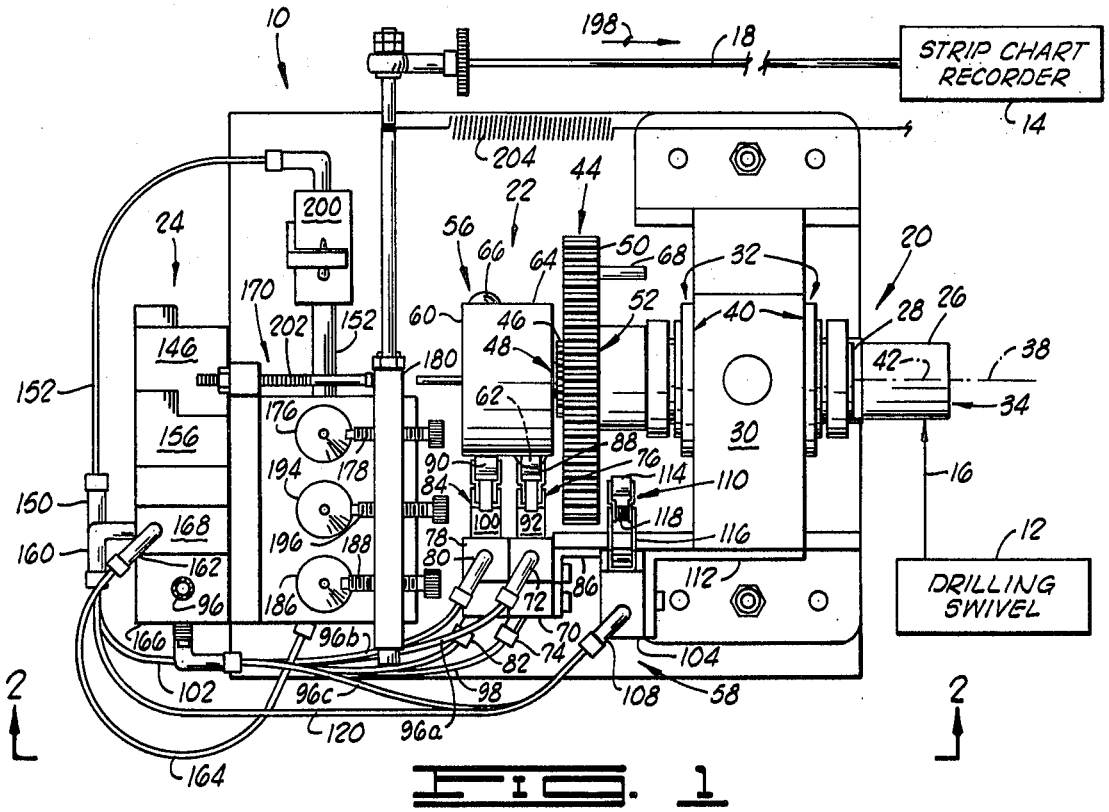
FIG. 1 is a top plan view of a rate of penetration recorder constructed in accordance with the preferred embodiment of the present invention.
Figure 2:
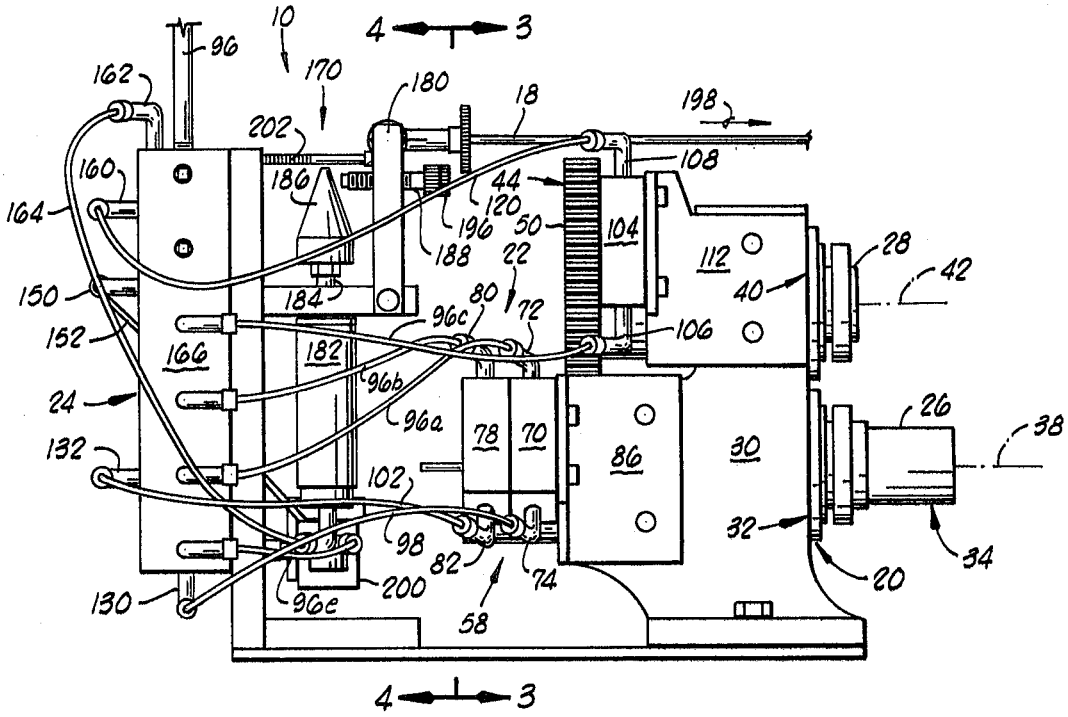
FIG. 2 is a side view of the rate of penetration recorder taken along the line 2—2 of FIG. 1.
Figure 3:
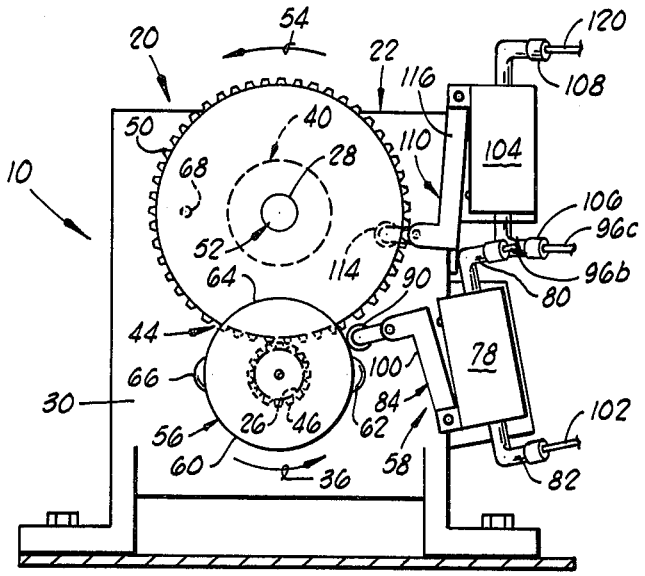
FIG. 3 is a cross sectional view of the rate of penetration recorder taken along the line 3—3 of FIG. 2.
Figure 4:
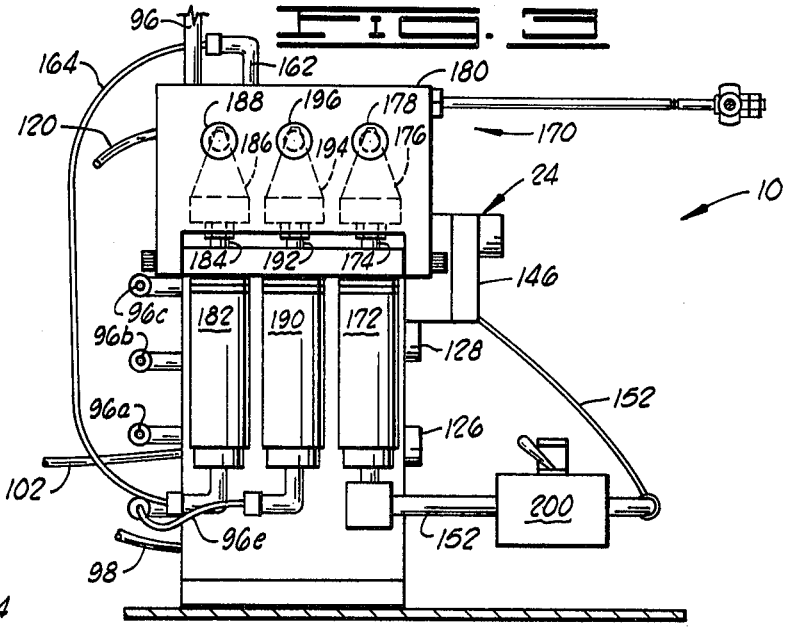
FIG. 4 is a cross sectional view of the rate of penetration recorder taken along the line 4—4 of FIG. 2.

Referring to the drawings in general, and to FIGS. 1 through 4 in particular, shown therein and referred to by the general reference number 10 is an improved rate of penetration recorder constructed in accordance with the preferred embodiment of the present invention. For the purposes of description, the rate of penetration recorder 10 is shown in combination with a drilling swivel 12 (shown diagramatically in FIG. 1) and a strip chart recorder 14 (also shown diagramatically in FIG. 1). The drilling swivel 12 is illustrated as being connected to the rate of penetration recorder 10 via a link 16 representing such conventional, well known apparatus as a cable having a take up drum, connected to, and forming an extension of, the rate of penetration recorder 10. In a similar manner, the strip chart recorder 14 is illustrated as being connected to the rate of penetration recorder 10 via a rod 18, wherein the rod 18 represents any number of conventional, well known apparatus such as a mechanical linkage to the recording pen (not shown) of the strip chart recorder 14.

The rate of penetration recorder 10 is comprised primarily of a shaft assembly 20, a sensor assembly 22, and a control circuit 24. The shaft assembly 20 is comprised primarily of a primary shaft 26 and a secondary shaft 28. The primary shaft 26 is journalled through a support block 30 via bearing assemblies 32 and has one end 34 thereof connected to the drilling swivel 12 via the link 16 so that the primary shaft 26 rotates once in a first direction 36 (see FIG. 3) about the longitudinal axis 38 thereof in response to the vertically downward movement of the drilling swivel 12 a predetermined penetration distance. Thus, for example, the connection between the drilling swivel 12 and the primary shaft 26 via the link 16 may be adjusted in a conventional manner so that the primary shaft 26 will rotate once in the first direction 36 about the longitudinal axis 38 thereof in response to the vertically downward movement of the drilling swivel 12 a distance of one foot.

The secondary shaft 28 is journalled through the support block 30 via bearing assemblies 40 with the longitudinal axis 42 thereof parallel to, but spaced a distance from, the longitudinal axis 38 of the primary shaft 26. A gear assembly 44 having a drive gear 46 connected to one other end 48 of the primary shaft 26, and a driven gear 50 connected to one end 52 of the secondary shaft 28, couples the rotation of the primary shaft 26 to the secondary shaft 28 at a rate dependent upon the number of teeth on the drive gear 46 relative to the number of teeth on the driven gear 50. Due to the manner in which the primary shaft 20 is connected to the drilling swivel 12 via the link 16, the secondary shaft 28 will rotate once in a second direction 54 (see FIG. 3) about the longitudinal axis 42 thereof in response to the vertically downward movement of the drilling swivel 12 a predetermined multiple of the penetration distance, depending upon the gear ratio of the gear assembly 44. Thus, for example, a gear ratio of 1 to 5 will result in the secondary shaft 28 rotating at 1/5 the rotational speed of the primary shaft 26 or, in other words, the secondary shaft 28 will rotate once in the second direction 54 about the longitudinal axis 42 thereof in response to every 5 rotations of the primary shaft 26 in the first direction 36.

The sensor assembly 22 includes a cam assembly 56 and a switch assembly 58. The cam assembly 56 is comprised primarily of a cam 60 connected to the end 48 of the primary shaft 26 and coaxial therewith, so that the cam 60 rotates at the same rate as the primary shaft 26. The cam 60 has a set lobe 62 connected to the periphery 64 thereof at an arbitrary radical position, and a reset lobe 66 connected to the periphery 64 a predetermined number of degrees around from the set lobe 62. For example, the reset lobe 66 has been illustrated in FIGS. 1 and 3 as being displaced approximately 180° away from the lobe 62 relative to the axis 38. In the preferred embodiment, the cam assembly 56 also includes a gate trip pin 68 connected to the driven gear 50 with the gate trip pin 68 extending parallel to, but displaced radially from, the axis 42 of the secondary shaft 28.

The switch assembly 58 is comprised primarily of a set switch 70 having an input terminal 72, an output terminal 74, and a switch actuator 76; and a reset switch 78 having an input terminal 80, an output terminal 82, and a switch actuator 84. The set switch 70 is connected to the support block 30 via a mounting flange 86 with a cam follower 88 portion of the switch actuator 76 resiliently biased against the periphery 64 of the cam 60 in the plane of the set lobe 62. In a similar manner, the reset switch 78 is connected to the support block 30 via the flange 86 with a cam follower 90 portion of the switch actuator 84 resiliently biased against the periphery 64 of the cam 60 but in the plane of the reset lobe 66. For convenience of reference, the rotary position of the primary shaft 26 at which the switch actuator 76, and in particular the cam follower 88 thereof, will engage the set lobe 62 and actuate the set switch 70 will be referred to as the set position. Similarly, the rotary position of the primary shaft 26 at which the switch actuator 84 of the reset switch 78, and in particular the cam follower 90 thereof, engages the reset lobe 66 and actuates the reset switch 78 will be referred to as the reset position. However, due to the rotary displacement of the reset lobe 66 relative to the set lobe 62, the reset position is displaced from the set position by the predetermined number of degrees of rotation of the primary shaft 26 in the first direction 36, as discussed above.

The set switch 70 is constructed in a conventional maner to connect the input terminal 72 to the output terminal 74 in response to the actuation theeof via the switch actuator 76 as upon the engagement of the cam follower 88 by the set lobe 62. However, as can be seen best in FIG. 3, the cam follower 88 is pivotally connected to a lever arm 92 portion of the switch actuator 76 and is biased outwardly therefrom via a spring (not shown) so that the rotation of the set lobe 62 passed the cam follower 88 in a direction opposite to the first direction 36 will result in substantially no movement of the switch actuator 76. Thus, assuming hereinafter that the input terminal 72 is connected to a suitable power supply 94 (see FIG. 5) via a signal path **96*a*, the set switch 70 will provide a set signal in the high state via a signal path 98 in response to the actuation thereof via the set lobe 62 upon the rotation of the primary shaft 26 in the first direction 36** to the set position. For the purposes of this discription, the various references to the signals being in the high or low states are intended to be construed in accordance with the conventional digital definitions thereof.

The reset switch 78 is constructed in a conventional manner to connect the input terminal 80 to the output terminal 82 in response to the actuation thereof via the switch actuator 84 as upon the engagement of the cam follower 90 by the reset lobe 66. However, as can be seen best in FIG. 3, the cam follower 90 is pivotally connected to a lever arm 100 portion of the switch actuator 84 and is biased outwardly therefrom via a spring (not shown) so that the rotation of the reset lobe 66 passed the cam follower 90 in a direction opposite to the first direction 36 will result in substantially no movement of the switch actuator 84. Thus, assuming hereinafter that the input terminal 80 is connected to the power supply 94 via the signal path **96*b*, the reset switch 78 will provide a reset signal in the high state via a signal path 102 in response to the actuation theeof via the reset lobe 66 upon the rotation of the primary shaft 26 in the first direction 36** to the reset position.

In the preferred embodiment, the switch assembly 58 also includes a gate switch 104 having an input terminal 106, an output terminal 108, and a switch actuator 110. The gate switch 104 is connected to the support block 30 via a mounting flange 112 with a cam follower 114 portion of the switch actuator 110 resiliently biased across the path of movement defined by the gate trip pin 68 upon the rotation of the secondary shaft 28. More particularly, the gate switch 104 is mounted as to be actuated via the gate trip pin 68 at substantially the same time as a predetermined actuation of the set switch 70 via the set lobe 62, depending upon the gear ratio of the gear assembly 44. For convenience of reference, the rotary position of the secondary shaft 28 at which the switch actuator 110, and in particular the cam follower 114 thereof, will engage the gate trip pin 68 and actuate the gate switch 104 will be referred to as the gate position.

The gate switch 104 is constructed in a conventional manner to connect the input terminal 106 to the output terminal 108 in response to the actuation thereof via the switch actuator 110 as upon the engagement of the cam follower 114 by the gate trip pin 68. However, as can be seen best in FIG. 3, the cam follower 114 is pivotally connected to a lever arm 116 portion of the switch actuator 110 and is biased outwardly therefrom via a spring 118 (see FIG. 1) so that the rotation of the gate trip pin 68 passed the cam follower 114 in a direction opposite to the second direction 54 will result in substantially no movement of the switch actuator 110. Thus, assuming hereinafter that the input terminal 106 is connected to the power supply 94 via a signal path 96c, the gate switch 104 will provide a gate signal in the high state via a signal path 120 in response to the actuator thereof via the gate trip pin 68 upon the rotation of the secondary shaft 28 in the second direction 54 to the gate position.

Figure 5:
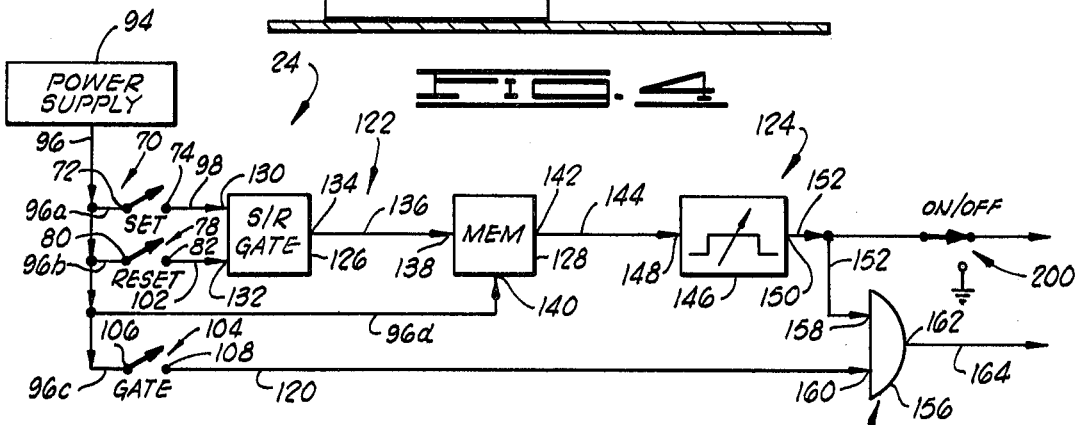
FIG. 5 is a schematic representation of the control circuit of the rate of penetration recorder shown in FIG. 1.

As can be seen best in FIG. 5, the control circuit 24 is comprised primarily of a latching circuit 122 and a pulse generator 124. The latching circuit 122, which is selectively positionable in mutually exclusive set and reset states, receives the set signal from the set switch 70 and the reset signal from the reset switch 78. In the manner of a conventional bistable multivibrator, the latching circuit 122 will be positioned in the set state in response to receiving, while in the reset state, the set signal in the high state from the set switch 70. On the other hand, the latching circuit 122 will be positioned in the reset state in response to receiving, while in the set state, the reset signal in the high state from the reset switch 78.

In the preferred embodiment, the latching circuit 122 is comprised of a set/reset gate 126 and a memory element 128. The set/reset gate 126 has a set input terminal 130 connected to the output terminal 74 of the set switch 70 via the signal path 98, a reset input terminal 132 connected to the output terminal 82 of the reset switch 78 via the signal path 102, and an output terminal 134. The set/reset gate 126 is constructed in a conventional manner to continuously provide an output signal in the high state via a signal path 136 in response to receiving the signal in the high state via the signal path 98. However, the set/reset gate 126 will cease to provide the output signal in the high state, that is, it will provide an output signal in the low state via the signal path 136, in response to receiving the reset signal in the high state via the signal path 102.

The memory element 128 has an input terminal 138 connected to the output terminal 134 of the set/reset gate 126 via the signal path 136, a supply terminal 140 connected to the power supply 94 via a signal path 96d, and an output terminal 142. The memory element 128 is constructed in a conventional manner to provide an output signal in the high state via a signal path 144 in response to receiving a signal in the high state from the set/reset gate 126 via the signal path 136, and to provide an output signal in the low state in response to receiving a signal in the low stae from the set/reset gate 126 via the signal path 136. Thus, the memory element 128 cooperates with the set/reset gate 126 by trapping or buffering the output signal provided by the set/reset gate 126.

The pulse generator 124 is connected to the latching circuit 122 and is responsive to the positioning thereof in the set state. More particularly, the pulse generator 124 provides an output signal for a predetermined time duration in response to the positioning of the latching circuit 122 in the set state. In the preferred embodiment, the pulse generator 124 is comprised of a monostable multivibrator 146 having an input terminal 148 connected to the output terminal 142 of the memory element 128 via the signal path 144, and an output terminal 150. The monostable multivibrator 146 is constructed in a conventional manner to provide an output pulse in the high state for a predetermined time duration via a signal path 152 in response to receiving a signal in the high state via the signal path 144.

As will be clear to those skilled in the art, the set and reset switches 70 and 78, respectively, are responsive to the rotation of the primary shaft 26 only in the first direction 36 due to the pivotal connection between the cam followers 88 and 90 and the respective lever arms 92 and 100. Further, the rotary displacement between the set and reset positions of the primary shaft 26, in conjunction with the latching action of the latching circuit 122 allows local oscillations of the drilling swivel up to approximately ½ the penetration distance about any particular set or reset position without false triggering. Finally, the controlled pulse provided by the pulse generator 124 in response to each latching action of the latching circuit 122 assures a predictable response each time the drilling swivel 12 has travelled vertically downwardly the penetration distance, regardless of the downward velocity of the drilling swivel 12 at that instant. Therefore, each output pulse provided by the monostable multivibrator 146 via the signal path 152 will be indicative of the vertically downward movement of the drilling swivel 12 the penetration distance. For convenience of reference, the output signal provided by the monostable multivibrator 146 via the signal path 152 will be referred to as the step-penetration signal.

In the preferred embodiment, the control circuit 24 also includes a gate circuit 154. The gate circuit 154 receives the gate signal provided by the gate switch 104 and the step-penetration signal provided by the monostable multivibrator 146, and provides an output signal in response to simultaneously receiving the gate signal and the step-penetration signal. More particularly, the gate circuit 154 is comprised of an AND gate 156 having one input terminal 158 connected to the output terminal 150 of the monostable multivibrator 146 via the signal path 152, a second input terminal 160 connected to the output terminal 108 of the gate switch 104 via the signal path 120, and an output terminal 162. The AND gate 156 is constructed in a conventional manner to provide an output signal in the high state via a signal path 164 in response to simultaneously receiving the gate signal in the high state from the gate switch 104 via the signal path 120 and a signal in the high state from the monostable multivibrator 146 via the signal path 152. Since the activation of the gate switch 104 via the gate trip pin 68 is substantially syncronized with the activation of the set switch 70 via the set lobe 62 due to the gear assembly 44, the AND gate 156 will provide an output pulse via the signal path 164 each time the drilling swivel 12 travels vertically downwardly the predetermined multiple of the penetration distance. For convenience of reference, the output signal provided by the AND gate 156 via the signal path 164 will be referred to as the multiple-penetration signal.

In view of the general availability of a power supply 94 of the pneumatic type on drilling platforms, the various active elements of the switch assembly 58 and of the control circuit 24 have been illustrated in the drawings as being of the pneumatic type. By way of example, functional modules suitable for use in the present invention may be obtained from the ARO Corporation of Bryan, Ohio, as follows:

| Function | Model No. |
|---|---|
| Set Switch 70 | 205-C |
| Reset Switch 78 | 205-C |
| Gate Switch 104 | 205-C |
| Set/Reset Gate 126 | 59181 |
| Memory Element 128 | 59113 |
| Multivibrator 146 | 59120 |
| AND Gate 156 | 59111 |

For convenience of assembly, the various connections to the power supply 94 via the signal path 96 may be facilitated through the use of a distributor manifOld 166 of conventional construction. Further, interconnection between the various elements of the control circuit 24 may be conveniently provided via a function base assembly 168 available as Model No. 59063 from the ARO Corporation.

In those situations when a mechanical output response is desired rather than a pneumatic output, an output assembly 170 such as that shown in FIGS. 1 through 4 may be employed. For example, the output pulses provided by the monostable multivibrator 146 may be connected to a first pneumatic cylinder 172 via the signal path 152, with the resultant movement of a ram 174 being transferred by a frustoconical portion 176 on one end thereof to the rod 18 via an adjusting screw 178 threaded through a pivoting crank arm 180. In a similar manner, the output pulses provided by the AND gate 156 may be connected to a second pneumatic cylinder 182 via the signal path 164, with the resultant movement of a ram 184 being transferred by a frusto-conical portion 186 on one end thereof to the rod 18 via an adjusting screw 188 threaded through the crank arm 180. If desired, an indication of the operating state of the control circuit 24 may be provided by connecting the power supply 94 to a third pneumatic cylinder 190 via a signal path 96e so that the resultant movement of a ram 192 having a frusto-conical portion 194 on one end thereof may be coupled to the rod 18 via an adjusting screw 196 threaded through the crank arm 180.

By way of example, the screws 178, 188 and 196 have been illustrated in FIG. 1 so that the rod 18 will be moved in the direction 198 a relatively small distance when the control circuit 24 is connected to the power supply 94, a relatively larger distance in response to an output pulse from the monostable multivibrator 146, and a relatively largest distance in response to an output pulse from the AND gate 156. Thus, a first discernable movement of the rod 18 will be provided in response to the conditioning of the control circuit 24 in the "ON" state, a second discernable movement of the rod 18 will be provided in response to the vertically downward movement of the drilling swivel 12 the penetration distance, and a third discernable movement of the rod 18 will be provided in response to the vertically downward movement of the drilling swivel 12 the predetermined multiple of the penetration distance. Assuming that the rod 18 is connected in a conventional manner to the recording pen portion (not shown) of the strip chart recorder 14, the various movements of the drilling swivel 12 will be accurately detected via the improved rate of penetration recorder 10 for recording on the output chart of the strip chart recorder 14.

If desired, an on/off switch 200, such as Model No. 223-C of the ARO Corporation, may be interposed in the signal path 152 to effectively prevent production of the step-penetration and the multiple-penetration signals in appropriate circumstances. In addition, the movement of the crank arm 180 may be confined to desired limits via a stop pin 202 in cooperation with a biasing spring 204.

Although the improved rate of penetration recorder 10 has been shown and described herein as being pneumatically operated in conjunction with additional interface apparatus facilitating cooperation with the drilling swivel 12 and an exemplary recording device 14, it must be recognized that various changes may be made in the arrangement and operation of the parts or elements comprising the preferred embodiment as disclosed herein without departing from the spirit and scope of the present invention as defined in the following claims.

What is claimed is:

1. In a rate of penetration recorder having a primary shaft portion connected to a drilling swivel, the primary shaft portion rotating once in a first direction about the longitudinal axis thereof in response to the vertically downward movement of the drilling swivel a predetermined penetration distance, the improvement comprising:

sensor means, including a portion connected to the primary shaft portion of the recorder and responsive to the rotation thereof, the sensor means providing a set signal in response to the rotation of the primary shaft portion in the first direction to a predetermined set position, and providing a reset signal in response to the rotation of the primary shaft portion in the first direction to a predetermined reset position, the reset position being displaced from the set position a predetermined number of degrees of rotation of the primary shaft portion in the first direction; and, circuit means connected to the sensor means and being selectively positionable in mutually exclusive set and reset states, the circuit means receiving the set and reset signals, being positioned in the set state in response to receiving the set signal while positioned in the reset state, and being positioned in the reset state in response to receiving the reset signal while positioned in the set state, the circuit means providing a step-penetration signal indicative of the vertically downward movement of the drilling swivel the penetration distance in response to being positioned in the set state.

2. The recorder of claim 1 wherein the circuit means are further defined to include:

latching means for receiving the set and reset signals, the latching means being positioned in a set state in response to receiving the set signal while in a reset state, and being positioned in the reset state in response to receiving the reset signal while in the set state; and pulse generating means connected to the latching means and responsive to the positioning thereof in the set state, the pulse generating means providing the step-penetration signal for a predetermined time duration in response to the positioning of the latching means in the set state.

3. The recorder of claim 2 wherein the latching means are further characterized as comprising a bistable multi-vibrator; and wherein the pulse generating means are further characterized as comprising a monostable multivibrator.

4. The recorder of claim 1 further characterized as having a secondary shaft connected to the drilling swivel and rotating once in a second direction about the longitudinal axis thereof in response to the vertically downward movement of the drilling swivel a predetermined multiple of the penetration distance; wherein the sensor means are further characterized as having a portion connected to the secondary shaft portion of the recorder and responsive to the rotation thereof, the sensor means providing a gate signal in response to the rotation of the secondary shaft portion in the second direction to a predetermined gate position; and wherein the circuit means is further characterized as receiving the gate signal and as providing a multiple-penetration signal indicative of the vertically downward movement of the drilling swivel the predetermined multiple of the penetration distance in response to being positioned in the set state while simultaneously receiving the gate signal.

5. The recorder of claim 4 wherein the circuit means are further defined to include:

gate means for receiving the gate signal and the step-penetration signal, and providing the multiple-penetration signal in response to simultaneously receiving the gate signal and the step-penetration signal.

6. The recorder of claim 5 wherein the gate means are further characterized as comprising an AND gate.

7. The recorder of claim 4 wherein the circuit means are further defined to include:

latching means for receiving the set and reset signals, the latching means being positioned in a set state in response to receiving the set signal while in a reset state, and being positioned in the reset state in response to receiving the reset signal while in the set state; and pulse generating means connected to the latching means and responsive to the positioning thereof in the set state, the pulse generating means providing the step penetration signal for a predetermined time duration in response to the positioning of the latching means in the set state.

8. The recorder of claim 7 wherein the latching means are further characterized as comprising a bistable multivibrator, and wherein the pulse generating means are further characterized as comprising a monostable multivibrator.

9. The recorder of claim 7 wherein the circuit means are further defined to include:

gate means for receiving the gate signal and the step-penetration signal, and providing the multiple-penetration signal in response to simultaneously receiving the gate signal and the step-penetration signal.

10. The recorder of claim 9 wherein the latching means are further characterized as comprising a bistable multivibrator; wherein the pulse generating means are further characterized as comprising a monostable multivibrator; and wherein the gate means are further characterized as an AND gate.

* * * * *